US005128875A

United States Patent [19]

Abumehdi et al.

[11] Patent Number: 5,128,875

[45] Date of Patent: Jul. 7, 1992

[54] FRANKING MACHINE

[75] Inventors: Cyrus Abumehdi, Harlow; Ronald W. Woodrow, Upminster, both of United Kingdom

[73] Assignee: Alcatel Business Systems Limited, United Kingdom

[21] Appl. No.: 390,822

[22] Filed: Aug. 8, 1989

[30] Foreign Application Priority Data

Aug. 18, 1988 [GB] United Kingdom ..... 8819647

[51] Int. Cl.[5] ..... G07B 17/04

[52] U.S. Cl. ..... 364/464.02

[58] Field of Search ..... 364/464.02, 464.03

[56] References Cited

U.S. PATENT DOCUMENTS 4,525,785 6/1985 Soderberg et al. ..... 364/464.02
4,535,419 8/1985 Dlugos et al. ..... 364/464.03 X
4,713,769 12/1987 Hills et al. ..... 364/464.02
4,916,623 4/1990 Check, Jr. ..... 364/464.02
4,916,626 4/1990 Vermesse ..... 364/464.02 X

*Primary Examiner*—Parshotam S. Lall

*Assistant Examiner*—Edward R. Cosimano

*Attorney, Agent, or Firm*—Shoemaker and Mattare, Ltd.

[57] ABSTRACT

A franking machine includes an electronic microprocessor having pairs of ports for communication between the microprocessor and other electronic devices comprising memories, a keyboard display device or a real time clock device. One port of each pair is utilized for clock signals and the other port of each pair is utilized for control, address and data signals. The memory devices are normally in an inactive mode and reading or writing of data is initiated by a signal format output by the microprocessor which specifies a device address and a memory location within the device. The communication between the microprocessor and the electronic devices includes the returning of acknowledgement signals from the devices to the microprocessor. In an initialization routine, the receipt of an acknowledgement signal or absence thereof may be utilized to enable the microprocessor to identify which one of a number of versions of a device is installed and to select an appropriate software routine.

15 Claims, 2 Drawing Sheets

| | | | | | | | | | | | | | | |
|---|---|---|---|---|---|---|---|---|---|---|---|---|---|---|
| S | DEVICE ADDRESS | W | A | STORE LOCATION ADDRESS | A | S | DEVICE ADDRESS | R/W | A | DATA | A | DATA | A | P |

FRANKING MACHINE

BACKGROUND OF THE INVENTION

This invention relates to franking machines and in particular to electronic circuits for carrying out accounting functions in franking machines It is known in franking machines to employ electronic microprocessors and memory devices for carrying out accounting functions in relation to franking transactions effected by the machine, the accounting functions including the maintenance of a record of credit available for use in franking mail items and a record of accumulated postage value used in franking mail items. The microprocessor and memory devices are implemented as semi-conductor devices fabricated in the form of semi-conductor integrated circuits. In operation, the microprocessor is controlled by a program to carry out various functions selected by a user of the machine for example by keying command signals on a keyboard. When the franking machine is in normal operational mode for carrying out franking, a user wishing to frank a mail item keys in the value of franking required and then operates one or more keys to cause the microprocessor to carry out a sequence of operations including carrying out accounting functions, setting the printwheels to the value of franking and finally driving the printwheels to effect printing of the franking on the mail item. The accounting functions carried out by the microprocessor include reading the contents of a descending register to check that there is sufficient credit available to cover the value of the required franking, decrementing the value stored in the descending register by an amount equal to the value of the franking, incrementing the value of the contents of an ascending register by an amount equal to the value of the franking, and incrementing by one the count in an item count register. The values stored in the registers, particularly those in the ascending and descending registers, must be maintained with absolute precision because these registers provide the accounting information which is the record of the monetary value of franking issued by the machine and for which payment has been made, in the case of pre-payment, or will be made to the postal authority. In order to maintain the integrity of the registers, each register is usually replicated so that each value is stored in four separate locations. The microprocessor periodically checks the magnitudes of each value stored in the registers and if there is any discrepancy between the magnitudes in the separate locations of any stored value, the microprocessor causes the machine to lock out and prevent further use for franking until it has been checked by a service engineer. The electronic circuits are housed in a secure housing designed to prevent unauthorized access to the circuits whereby the machine could be used fraudulently. In addition it is necessary to ensure that stray electrical signals, such as pulse spikes on the mains power supply, are not picked up by the electronic circuits to cause false values to be stored in the memory devices. Conventionally, accessing of memories utilises parallel data transfer and the address signals for addressing a specified memory location are input in parallel to the memory device. A further signal is utilised to select reading from or writing to the specified location of the memory. Accordingly the microprocessor and memory devices are interconnected for the reading and writing of data by means of a plurality of lines, one group of lines being utilised for carrying address signals to specify the memory location to which data is to be written or from which data is to be read, another group of lines for carrying parallel data signals and a line for carrying control signals from the microprocessor to the memory devices. The address and data lines are actively connected to the memory devices and hence there is a high risk that any stray signal induced on a data line will cause distortion of the data signals and result in corruption of the value stored in one or more of the registers of the memory devices. The microprocessor, memory devices and other electronic components are mounted on a printed circuit board having conductive tracks to provide the required connections between the components. The plurality of lines for carrying data signals and address signals between the microprocessor and the memory devices occupy a significant area of the printed circuit board and this places undesirable constraints on the minimum size of printed circuit board which can be used to mount and interconnect the components.

SUMMARY OF THE INVENTION

According to the invention a franking machine includes an electronic microprocessor; first and second ports for communication with the microprocessor; an electronic device having a first terminal for input and output of both data signals and control signals; a second terminal for input of clock signals; a first connection between said first port and said first terminal; a second connection between the second port and the second terminal; and said microprocessor being operable to transmit control signals to said electronic device via said first port and said first connection and clock signals to said electronic device via the second port and the second connection and to cause signals representing data to be transmitted between the microprocessor and said electronic device via said first port and said first connection.

The franking machine may include a plurality of electronic devices connected to different ports communicating with the microprocessor.

Preferably each electronic device has an address corresponding thereto and said microprocessor is operable to transmit to the selected device an address signal corresponding to that device to cause that device to respond with an acknowledgement signal.

One or more of the electronic devices may be memory devices including a plurality of addressable storage locations.

The franking machine may include means operative to control the microprocessor to perform an initialisation routine including sending a first message containing a first device address signal to the electronic device; said device being operative in response to said first device address signal corresponding to said device address to return an acknowledgement signal to the microprocessor; and said microprocessor being operative in response to said acknowledgement signal to continue with said initialisation routine.

The microprocessor may be operative in the absence of the acknowledgement signal within a predetermined time interval to send a second message containing a second device address signal to that device; said device being operative in response to the second device address signal corresponding to the device address to return an acknowledgement signal to the microprocessor.

The electronic device may be a device selected from a plurality of devices, each of said plurality of devices including a different device address indication; the microprocessor being controlled under the initialisation routine to send a sequence of messages to the electronic device, each message containing a different address signal; means storing a plurality of software routines associated respectively to the different devices; and wherein the microprocessor is operative upon receipt of the acknowledgement signal in response to sending a message containing an address signal corresponding to the device address indication of the selected device to select that software routine associated with the selected device.

BRIEF DESCRIPTION OF THE DRAWING

An embodiment of the invention will now be described by way of example with reference to the drawings in which.

DESCRIPTION OF THE PREFERRED EMBODIMENT

Figures 1, 2:
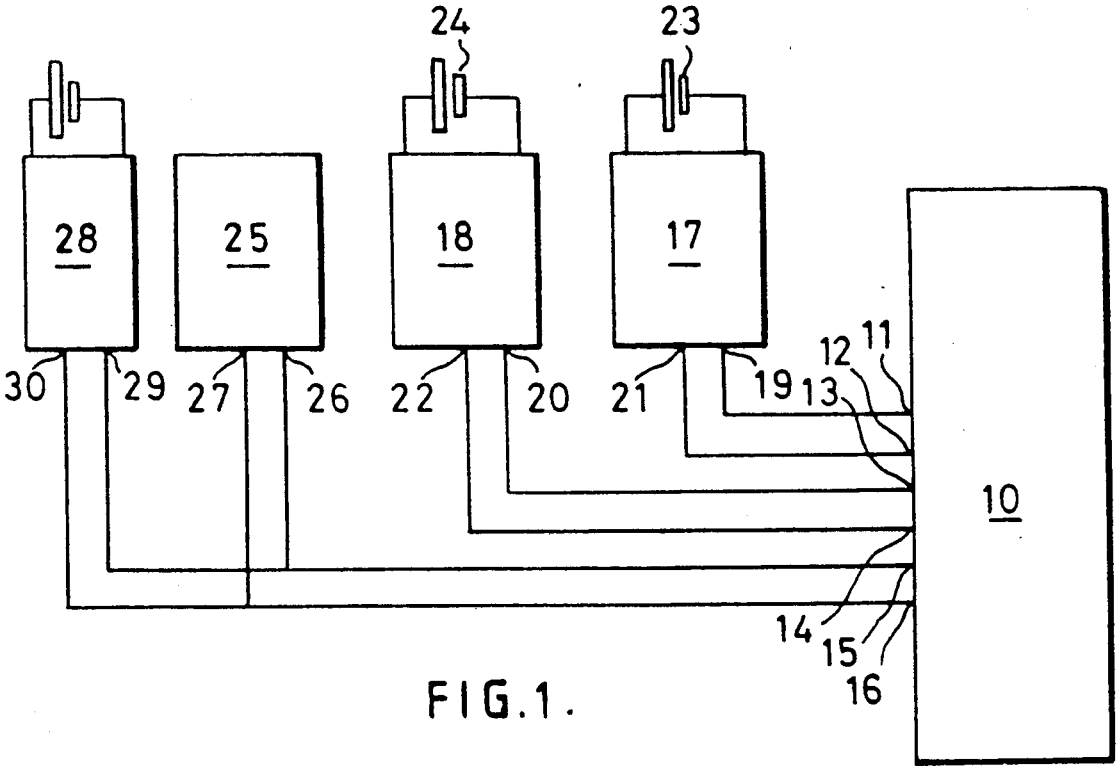
FIG. 1 is a block circuit diagram of a part of the electronic accounting and control circuit of a franking machine.
FIG. 2 illustrates a format of signals used in data transfer.

Referring to the drawing, a microprocessor 10 has a plurality of ports 11-16 for the input and output of signals to and from the microprocessor. In operation, the microprocessor is controlled to output clock signals on ports 11, 13 and 15 and to configure the ports 12, 14 and 16 as input/output terminals for signals relating to data transfer. The ports of the microprocessor handle both input and output of signals and hence are dual direction ports. Accordingly the microprocessor 10 is a device having this dual direction port characteristic. A suitable component for use as the microprocessor 10 is available commercially under the type number 80C154 JS.

The franking machine is provided with two separate memory devices 17, 18 which respectively have terminals 19, 20 for the input of clock signals and terminals 21, 22 for the input and output of signals relating to data transfer. The memory devices include control and address circuits which respond to a predetermined format of signals for the transfer of data to and from storage locations within the memory devices. A suitable commercially available component for the memory devices is that marketed by Philips under the type number PCF 8570. The format of signals and the operations of reading and writing data from and to the storage locations will be described hereinafter.

The ports 11, 12 of the microprocessor 10 are connected respectively to the terminals 19 and 21 of memory device 17 and the ports 13, 14 of the microprocessor are connected respectively to the terminals 20, 22 of the memory device 18. Thus the memory devices 17, 18 receive clock signals on terminals 19, 20 and have their terminals 21, 22 connected to the microprocessor ports for the transfer of signals relating to data transfer to and from the microprocessor. Each of the memory devices 17, 18 includes a first set of storage locations designated to provide a descending register, an ascending register and a tote or item count register. In addition, to provide additional security for maintaining integrity of the stored data, each memory device includes a second set of storage locations designated to provide a duplicate descending register, a duplicate ascending register and a duplicate tote register. Thus each of the registers is implemented in each of four set of storage locations, two sets of locations in each of two memory devices. The construction of the memory devices is such that data is retained in the storage locations only when power is applied to the memory devices. Accordingly, in order to ensure that data is not lost when the franking machine is switched off or in the event of a power failure, batteries 23, 24 are provided to power the memory devices in a inactive mode to ensure that the memory devices are always energised with power. In this inactive mode the memory devices are incapable of being accessed and accordingly they are immune to any signals which may be induced by stray signals on their terminals 21, 22. As a result there is little risk of corruption of data stored in the memory devices during any period when the franking machine is switched off. In this inactive mode the memory devices require very little power and hence the batteries have an extremely long operational life.

The format of signals used in data transfer between the microprocessor and the memory devices is shown in FIG. 2. The microprocessor acts as a master and controls the reading and writing of data from and to the storage locations of the memory devices by a string of signals in the format shown in FIG. 2. Reading or writing to both memory devices is accomplished in the same manner and, by way of illustration, reading and writing from a storage location in memory device 17 will now be described. Reading or writing is initiated by a start bit 'S' input on terminal 21 and is followed by signals representing an address of for example 7 bits corresponding to the memory device 17. The next bit 'W' of the string determines the direction of transfer between the microprocessor and the memory device of the succeeding block of signals. The next block of signals will represent a storage location within the memory device 17 to which data is to be written or from which data is to be read by the microprocessor and hence this bit 'W' has a value, for example '0', which determines that the succeeding block will be transferred in a direction from the microprocessor to the memory device. Prior to transmission of the address of the storage location, the memory device sends an acknowledgement signal 'A' to the microprocessor. On receipt of the acknowledgement signal 'A', the microprocessor transmits the desired storage location address to the memory device 17. A further acknowledgement signal 'A' is then sent back to the microprocessor by the memory device 17. The start bit 'S' is repeated by the microprocessor followed by the address corresponding to the memory device 17. Next a bit 'R/W' having a value '1' or '0' depending upon whether data is to be read from or written to the addressed storage location in the memory device 17 is sent by the microprocessor. After the memory device 17 sends an acknowledgement signal 'A' the microprocessor receives or transmits one or more blocks of data read from or to be written into the addressed storage location, each block of data being followed by an acknowledgement 'A' from the memory device 17. Finally at the end of a data transfer a stop bit 'P' is sent by the microprocessor to terminate access to the memory device.

When data is to be written to or read from the other memory device 18, the string of signals is transmitted between the port 14 of the microprocessor and the terminal 22 of the device 18. The string, after the start bit 'S' will include an address corresponding to the memory device 18. Thereafter, transmission of data in either direction is effected as described above in relation to transfers between the microprocessor and memory device 17.

It will be appreciated that since only one memory device is connected to a port, selection by the microprocessor of one of the ports in itself addresses the desired memory device and hence including an address signal corresponding to the memory device in the string of signals sent by the microprocessor is not essential merely from the need to address the memory device. However, the inclusion of the address signals corresponding to the memory device in the string of signals provides improved protection against undesired accesses to the memory devices because access to a storage location of the memory devices is only possible after the required memory device has been correctly addressed. Accordingly, stray induced signals resulting from interference are extremely unlikely to result in generation of a signal which either of the memory devices recognise as their respective address. The possibility of induced signals being able to affect data stored in any storage location of the memory devices is even more remote.

However, if desired and particularly if protection against interference is less critical, more than one device may be connected to one port of the microprocessor as is described hereinafter in relation to a third pair of ports 15, 16. The third pair of ports 15, 16 of the microprocessor 10 are provided for communication with a keyboard and display unit 25. Clock signals are transmitted by the microprocessor 10 via port 15 to a terminal 26 of the keyboard and display unit 25. Signals relating to data transfer between the microprocessor 10 and the display device 25 are carried via port 16 and a terminal 27 of the device 25. Data transfers between the microprocessor and the device 25 are effected in a similar manner as described above in relation to reading and writing data in the memory devices 17, 18. Receipt of a device address signal on terminal 27, from the microprocessor 10, corresponding to the address of the device 25 causes the device 25 to send back an acknowledgement signal to the microprocessor 10. In addition to the device 25, further devices may be connected to the ports 15, 16. For example, a real time clock device 28 may be provided. The device 28 has terminals 29, 30 respectively for clock signals and real time data signals. When the microprocessor desires to access the device 28 to read out real time data signals therefrom, the microprocessor, after transmitting a start signal 'S', transmits a device address signal corresponding to the device address of the device 28. Upon receipt of this device address signal, the device 28 sends back an acknowledgement signal 'A' as hereinbefore described in relation to accesses of the memory devices 17, 18. It will be appreciated that the devices 25 and 28 respond only to device address signals corresponding to the respective devices and hence if one device is addressed, the other device does not respond or become activated.

If desired the use of a device address signal may be utilised to determine which of a number of possible devices is or are connected to the port of the microprocessor. For example if it is desired to provide the franking machine with a selected one of a number of differing versions of a device, each version is configured to have a different device address. This may be effected by selective hardwiring of the addresses in the different versions of the device. During an initialisation routine carried out by the microprocessor under control of its program, the microprocessor sends a message containing a device address signal corresponding to one of the possible versions of the device. If the device address signal corresponds to the device address of that version of device installed in the franking machine an acknowledgement signal is returned by the device to the microprocessor and the microprocessor then selects a software program routine corresponding to that version of the device. However if no acknowledgement is received within a predetermined time interval, the microprocessor sends a message containing a device address corresponding to another possible version of the device. If there are only two possible versions of the device, this second message will result in return of an acknowledgement by the device. However if there are a larger number of possible versions of the device, the microprocessor continues to send messages containing device addresses in turn corresponding to other versions of the device until an acknowledgement is received back from the device. Receipt of an acknowledgement then serves to confirm the version of device installed and the software routine is selected accordingly. If after all the devices addresses have been included in turn in the messages and no acknowledgement is returned, a fault condition exists and this will be indicated by an appropriate signal or indication to the user of the franking machine.

The recognition by the microprocessor of which one of a number of differing devices is installed is beneficial in enabling the construction of franking machines providing differing user facilities utilising units providing these differing facilities together with other units providing functions required in common for a range of franking machines. For example, a range of franking machines may be constructed using the same unit containing the microprocessor for carrying out accounting and control functions while providing variations in facilities to the user by the provision of differing versions of the keyboard and display device.

The operation of the microprocessor in carrying out accounting and control functions and in effecting data transfers between the microprocessor and the memory devices and display unit 25 is controlled by a program stored in non-volatile memory (not shown). It will be understood that, since a user of the franking machine selects desired modes of operation of the machine and inputs data such as franking values required by means of the keyboard of the unit 25, the microprocessor is controlled by its program to periodically carry out a read operation in respect of the unit 25 to ascertain whether any key has been operated by a user. In carrying out accounting functions which depend upon a value stored in any register of the memory devices 17, 18 the microprocessor is caused to access in turn all storage locations comprising replications of that register in both memory devices to check that the values in all replications of that register are identical and when a new value is written to a register, all the replications of that register are addressed in turn by the microprocessor to write the new value in each of the replications of the register.

Figure 3:
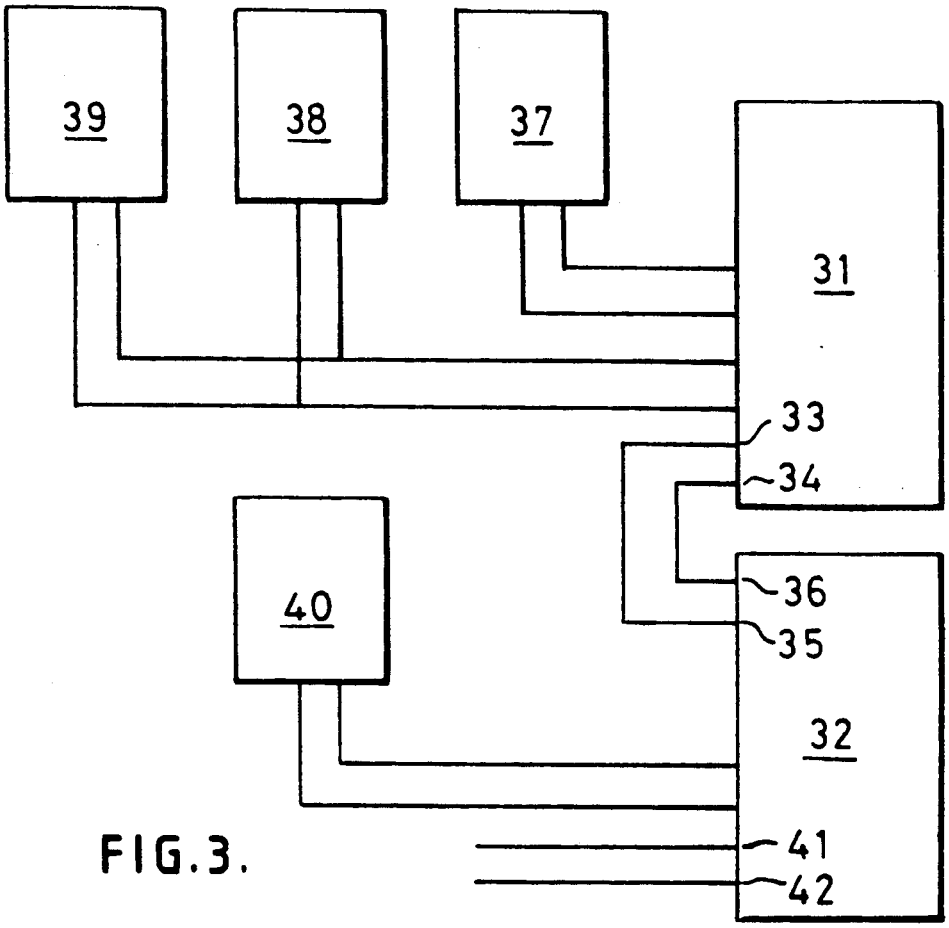
FIG. 3 is a block circuit diagram of a part of an alternative electronic accounting and control circuit of a franking machine and FIG. 4 is a block diagram of a franking machine system in which a franking machine is connected to other devices external to the franking machine.

If desired instead of providing a single microprocessor device 10 to carry out all the accounting and control functions required to be performed in the franking machine, one or more microprocessor devices may be provided and each microprocessor may be allocated to perform selected ones of the accounting and control functions. The microprocessors may be interconnected in the same manner that the microprocessor 10 is connected to the devices 17, 18, 25 and 28. An arrangement incorporating two microprocessors is shown in FIG. 3. Microprocessors 31, 32 have pairs of ports 33, 34 and 35, 36 respectively which are interconnected. Ports 33 and 35 carry clock signals from one microprocessor to the other and ports 34, 36 carry data signals between the microprocessors. In this arrangement shown in FIG. 3, the microprocessor 31 has other pairs of ports connected to a memory device 37, a display and keyboard device 38 and a real time clock device 39 as has been described hereinbefore with reference to FIG. 1. Microprocessor 32 has a pair of ports connected to a second memory device 40 and in addition has a further pair of ports 41, 42 which may be used for connection to any other required device for example a driver device for a printer or an interface device for communication with devices external to the franking machine. In this arrangement the microprocessor 31 is controlled by software to perform functions related to the keyboard and display device 38 such as responding to input signals generated by operation of keys by a user and displaying data and information on the display for instruction of a user of the franking machine. The performance of accounting functions may be allocated to either one of the microprocessors 31, 32, the results of accounting being written directly to the memory device connected to the microprocessor and in addition being sent to the other microprocessor for writing into the memory device connected to the other microprocessor.

Alternatively, if desired, both microprocessors may be controlled to perform accounting functions and the results from both microprocessors may be compared to check that the function has been correctly performed before writing the accounting data to the respective memory devices. The microprocessor 32 is controlled by software to operate a printer driver connected to ports 41, 42 to print a franking impression on a mail item being franked. When transmission of data is required from one microprocessor to the other, the microprocessor requiring to send or receive data to or from the other microprocessor acts as a so-called master device and sends clock signals to the other microprocessor and controls data transfer as described hereinbefore, the other microprocessor then acting as a slave device in the same manner as, for example, the memory devices in relation to data transfer between a microprocessor and the memory device. The master slave relationship is determined by which microprocessor calls for a data transfer and is not dependent upon the direction of data transfer. It will be appreciated that more than two microprocessors may be provided and the microprocessors and other devices may be connected in configurations other than that shown in FIG. 3. The allocation of functions to the microprocessors as described hereinbefore is merely one example of such an allocation and it is to be understood that the functions may be allocated differently to the microprocessors. While the memory devices have been shown as devices separate from the microprocessors, microprocessors having sufficient internal memory capacity may be used in which case the accounting data would be stored in these internal memories of the microprocessors and the memory devices 37 and 40 would not be required.

Figure 4:
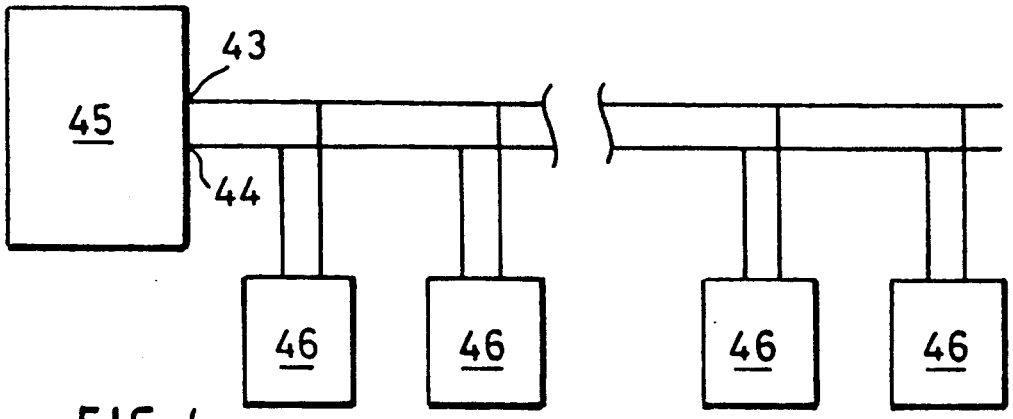

In addition to the transmission of data between devices within a franking machine by means of pairs of ports of a microprocessor, a pair of connections 43, 44 to a port of the microprocessor of a franking machine 45 may be utilised to connect to similar ports of microprocessors of external systems or to terminals of external passive devices 46 as shown in FIG. 4. A single pair of connections, one connection 43 for clock signals and the other connection 44 for data signals may be utilised to interconnect a number of external systems or devices 46 with the franking machine 45.

We claim:

1. A franking machine including an electronic microprocessor; first and second ports for communication with the microprocessor; an electronic device having a first terminal for input and output of both data signals and control signals and a second terminal for input of clock signals; a first connection between said first port and said first terminal; a second connection between the second port and the second terminal; said microprocessor being operable to transmit control signals to said electronic device via said first port and said first connection, to transmit clock signals to said electronic device via the second port and the second connection and to cause signals representing data to be transmitted between the microprocessor and said electronic device via said first port and said first connection; said electronic device including a device address represented therein; and including means operative to control said microprocessor to perform an initialisation routine including sending a first message containing a first device address signal to said device; said device being operative in response to said first device address signal corresponding to said device address to return an acknowledgement signal to said microprocessor; and said microprocessor being operative in response to said acknowledgement signal to continue with said initialisation routine.

2. A franking machine as claimed in claim 1 wherein the microprocessor is operative in the absence of the acknowledgement signal within a predetermined time interval to send a second message containing a second address signal to that device; said device being operative in response to the second device address signal corresponding to the device address to return an acknowledgement signal to the microprocessor.

3. A franking machine as claimed in claim 1 wherein the electronic device is a device selected from a plurality of devices, each said plurality of devices including a different device address indication; the microprocessor is controlled under the initialisation routine to send a sequence of messages to the electronic device, each message containing a different address signal; means storing a plurality of software routines associated respectively with the different devices; and wherein the microprocessor is operative upon receipt of the acknowledgement signal in response to sending a message containing an address signal corresponding to the device address indication of the selected device to select that software routine associated with the selected device.

4. A franking machine comprising an electronic device identified by a device address and including a first terminal for input and output of both data signals and control signals and a second terminal for input of clock signals; an electronic microprocessor; said microprocessor including first and second ports for communication with the microprocessor; said first port being connected solely to said first terminal; said second port being connected solely to said second terminal; and said microprocessor being controlled to transmit a device address signal and control signals to said electronic device via said first port and said first connection and to transmit clock signals to said electronic device via the second port and the second connection; said electronic device being operative when said device address signals correspond to said device address to return an acknowledgement signal via said first terminal and first connection to said first port of said microprocessor and said microprocessor being operative in response to said acknowledgement signal to cause signals representing data to be transmitted between the microprocessor and said electronic device via said first port and said first connection.

5. A franking machine as claimed in claim 4 wherein said electronic device comprises a memory including a plurality of data storage locations and wherein the microprocessor is operable to transmit via the first port and first connection to the first terminal a storage location address signal to select one of said data storage locations and thereafter to carry out a transfer of data between said selected data storage location and said microprocessor.

6. A franking machine as claimed in claim 4 including a plurality of electronic devices each identified by different device addresses respectively and each including first and second terminals; wherein the microprocessor includes a plurality of pairs of first and second ports; a plurality of first connection means connecting the first ports each to a different one of the first terminals respectively, each first port being connected only to one said first terminal; a plurality of second connection means connecting said second ports to a different one of said second terminals respectively, each second port being connected only to one said second terminal; said microprocessor being controlled to effect a data transfer with a selected one of said electronic devices by selection of a pair of first and second ports, transmission via the selected first port to the selected device of an address signal corresponding to the device address of said selected device and in response to receipt of an acknowledgement signal at the selected first port transferring data between said selected device and said microprocessor.

7. A franking machine comprising first and second microprocessors;

a first electronic identified by a first device address and including a first terminal for input and output of data and control signals and a second terminal for input of clock signals; said first microprocessor including a first port connected solely to said first terminal and a second port connected solely to said second terminal;

a second electronic device identified by a second device address and including a third terminal for input and output of data and control signals and a fourth terminal for input of clock signals; said second microprocessor including a third port connected solely to said third terminal and a fourth port connected solely to said fourth terminal;

said first microprocessor being identified by a third device address and further including a fifth port for data and control signals and a sixth port for clock signals;

said second microprocessor further including a seventh port connected solely to said fifth port and an eighth port connected solely to said sixth port;

said first microprocessor being operable to transmit said first device address signal and control signals to said first electronic device via said first port and to transmit clock signals to said electronic device via said second port; said first electronic device being operative in response to said first device address signals corresponding to said first device address to return a first acknowledgement signal via said first terminal to said first port of said first microprocessor and said first microprocessor being operative in response to said first acknowledgement signal to enable signals representing data to be transmitted between said first microprocessor and said first electronic device via said first port and said first terminal;

said second microprocessor being operable to transmit said second device address signal and control signals to said second electronic device via said third port and to transmit clock signals to said second electronic device via said fourth port; said second electronic device being operative in responsive to said second device address signals corresponding to said second device address to return a second acknowledgement signal via said third terminal to said third port of said second microprocessor and said second microprocessor being operative in response to said second acknowledgement signal to enable signals representing data to be transmitted between said second microprocessor and said second electronic device via said third port and said third terminal;

said second microprocessor further being operable to transmit a third device address signal via said seventh port to said fifth port of said first microprocessor; said first microprocessor being operative in response to said third device address signal corresponding to said third device address to send a third acknowledgement signal to said second microprocessor; said second microprocessor being operative in response to receipt of said third acknowledgement signal to effect transfer of data signals between said fifth and seventh ports.

8. A franking machine as claimed in claim 7 wherein said first electronic device comprises a memory device.

9. A franking machine as claimed in claim 7 wherein said first electronic device comprises a data entry device.

10. A franking machine as claimed in claim 7 wherein said first electronic device comprises a data display device.

11. A franking machine as claimed in claim 10 wherein said second electronic device comprises a memory device.

12. A franking machine comprising an electronic device identified by a device address and including a first terminal for input and output of both data signals and control signals and a second terminal for input of clock signals; an electronic microprocessor; said microprocessor including first and second ports for communication with the microprocessor; said first port being connected exterminally of said microprocessor solely to said first terminal; said second port being connected exterminally of said microprocessor solely to said second terminal; and said microprocessor being controlled to transmit a device address signal and control signals to said electronic device via said first port and said first connection and to transmit clock signals to said electronic device via the second port and the second connection; said electronic device being operative to receive signals representing data only in response to correspondence between said device address signals and said device address; said electronic device being operative after receipt of said device address signals corresponding to said device address to return an acknowledgement signals via said first terminal and first connection to said first port of said microprocessor and sad microprocessor being operative in response to said acknowledgement signal to cause said signals representing data to be transmitted between said microprocessor and said electronic device via said first port and said first connection.

13. A franking machine comprising an electronic device including a first terminal for input and output of both data signals and control signals, a second terminal for input of clock signals and a device address represented in said device identifying said device; an electronic microprocessor; said microprocessor including first and second ports for communication with the microprocessor; said first port being connected solely to said first terminal; said second port being connected solely to said second terminal; and said microprocessor being controlled to transmit a device address singal and control signals to sadi electronic device via said first port and said first connection adn to transmit clock signals to said electronic device via the second port and the second connection; said electronic device being operative in response to correspondence between said device address signals received from said microprocessor and said device address represented in said device to return an acknowledgement signal via said first terminal and first connection to said first port of said microprocessor and said microprocessor being operative in response to said acknowledgement signal to cause signals representing data to be transmitted between the microprocessor and said electronic device via said first port and said first connection.

14. A franking machine comprising first and second microprocessor;

a first electronic device including a first terminal for input and output of data and control signals, a second terminal for input of clock signals and a first device address represented in said first device and identifying said first device; said first microprocessor including a first port connected solely to said first terminal and a second port connected solely to said second terminal;

a second electronic device including a third terminal for input and output of data and control signals, a fourth terminal for input of clock signals and a second device address represented in said second device identifying said second device; said second microprocessor including a third port connected solely to said third terminal and a fourth port connected solely to said fourth terminal;

said first microprocessor further including a fifth port for data and control signals, a sixth port for clock signals and a third device address represented in said first microprocessor identifying said first microprocessor;

said second microprocessor further including a seventh port connected solely to said fifth port and an eighth port connected solely to said sixth port;

said first microprocessor being operable to transmit a first device address signal and control signals to said first electronic device via said first port and to transmit clock signals to said electronic device via said second port; said first electronic device being operative in response to correspondence between said first device address signals and said first device address to return a first acknowledgement signal via said first terminal to said first port of said first microprocessor and said first microprocessor being operative in response to said first acknowledgement signals to enable signals representing data to be transmitted between said first microprocessor and said first electronic device via said first port and said first terminal;

said second microprocessor being operable to transmit a second device address signal and control signals to said second electronic device via said third port and to transmit clock signals to said second electronic device via said fourth port; said second electronic device being operative in response to correspondence between said second device address signals and said second device address to return a second acknowledgement signals via said third terminal to said third port of said second microprocessor and said second microprocessor being operative in response to said second acknowledgement signal to enable signals representing data to be transmitted between said second microprocessor and said second electronic device via said third port and said third terminal;

said second microprocessor further being operable to transmit a third device address signal via said seventh port to said fifth port of said first microprocessor; said first microprocessor being operative in response to correspondence between said third device address signal and said third device address to send a third acknowledgement signals to said second microprocessor; said second microprocessor being operative in response to receipt of said third acknowledgement signal to effect transfer of data signals between said fifth and seventh ports.

15. A franking machine comprising an electronic device including a first terminal for input and output of both data signals and control signals, a second terminal for input of clock signals and a device address represented in said device identifying said device; an electronic microprocessor; said microprocessor including first and second ports for communication with the microprocessor; said first port being connected exterminally of said microprocessor solely to said first terminal; said second port being connected externally of said microprocessor solely to said second terminal; and said microprocessor being controlled to transmit a device address signal and control signals to said electronic device via said first port and said first connection and to transmit clock signals to said electronic device via the second port and the second connection; said electronic device being operative to receive signals representing data only in response to correspondence between said device address signal and said device address; said electronic device being operative after receipt of said device address signal corresponding to said device address to return an acknowledgement signal via said first terminal and first connection to said first port of said microprocessor and said microprocessor being operative in response to said acknowledgement signals to cause and signals representing data to be transmitted between said microprocessor and said electronic device via said first port and said first connection.

* * * * *